United States Patent [19]

Erdmann et al.

[11] Patent Number: 4,580,497

[45] Date of Patent: Apr. 8, 1986

[54] MUNITION

[75] Inventors: David P. Erdmann, Hopkins; Dennis L. Kurschner, Minnetonka; John C. Timmerman, St. Paul, all of Minn.

[73] Assignee: Honeywell, Inc., Minneapolis, Minn.

[21] Appl. No.: 581,850

[22] Filed: Feb. 21, 1984

[51] Int. Cl.[4] ..... F42C 13/08

[52] U.S. Cl. ..... 102/212; 102/427

[58] Field of Search ..... 102/427, 212; 340/547, 340/551, 552

[56] References Cited

U.S. PATENT DOCUMENTS 3,509,791 5/1970 Pechamat et al. ..... 102/427

4,308,501 12/1981 Tuccinardi et al. ..... 102/427

*Primary Examiner*—Charles T. Jordan

*Attorney, Agent, or Firm*—Roger W. Jensen

[57] ABSTRACT

In combination: an air core coil; a passive detector connected to said coil for giving a first output in response to change in the ambient magnetic field due to movement of a magnetic body near the coil; an active detector connected to the same coil and operable to create a local magnetic field about the coil and to give a second output in response to changes in the local field due to the movement of the body; apparatus energizing the active detector in response to the output of the passive detector; and apparatus giving a further output in response to simultaneous outputs from both the detectors.

5 Claims, 8 Drawing Figures

MUNITION

FIELD OF THE INVENTION

This invention relates to the field of munitions, and particularly to land mines having military vehicles as their targets.

BACKGROUND OF THE INVENTION

It is known that the crossing of particular land areas by military vehicles can be interdicted by distributing a plurality of land mines in the area. Each mine is capable of independently fuzing upon the approach of military vehicles. Two types of such mines which operate on magnetic principles are known.

Mines of the passive type operate in the mangnetostatic mode: they sense the distortion of the earth's magnetic field by the approach of a vehicle, or they may sense any magnetization residual in the vehicle itself. They ordinarily have a ferromagnetic-core sensing mechanism to increase their sensitivity, and operate with very low battery drain and hence remain operative for extended periods. In addition, they are subject to countermeasure techniques, and also are triggered by vehicle side-passes at distances where the resulting discharge does not damage the vehicle and is thus wasted.

Mines of the active type operate by creating a local electromagnetic field and detecting distortion of that field caused by the approach of a vehicle. They are less subject to side pass difficulties and to countermeasures, but require so much energy that their batteries quickly discharge and the effective life of the mine is intolerably reduced.

A further desirable characteristic for land mines should be mentioned. For direct overpasses, a mine is more effective beneath the front axle and cab portion of a wheeled vehicle, but is more effective beneath the center of the tank: accordingly, it is desirable that a mine discharge at an optimum point in the overpass of a vehicle, depending on the nature of the vehicle.

BRIEF SUMMARY OF THE INVENTION

The present invention is a mine fuse design combining the advantages of passive and active modes to give munitions having low power demand, low cost, low false alarms, excellent target localization, side pass rejection, and counter measure resistance, and the possibility of discrimination between target types.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE PREFERRED EMBODIMENT

Figure 1:
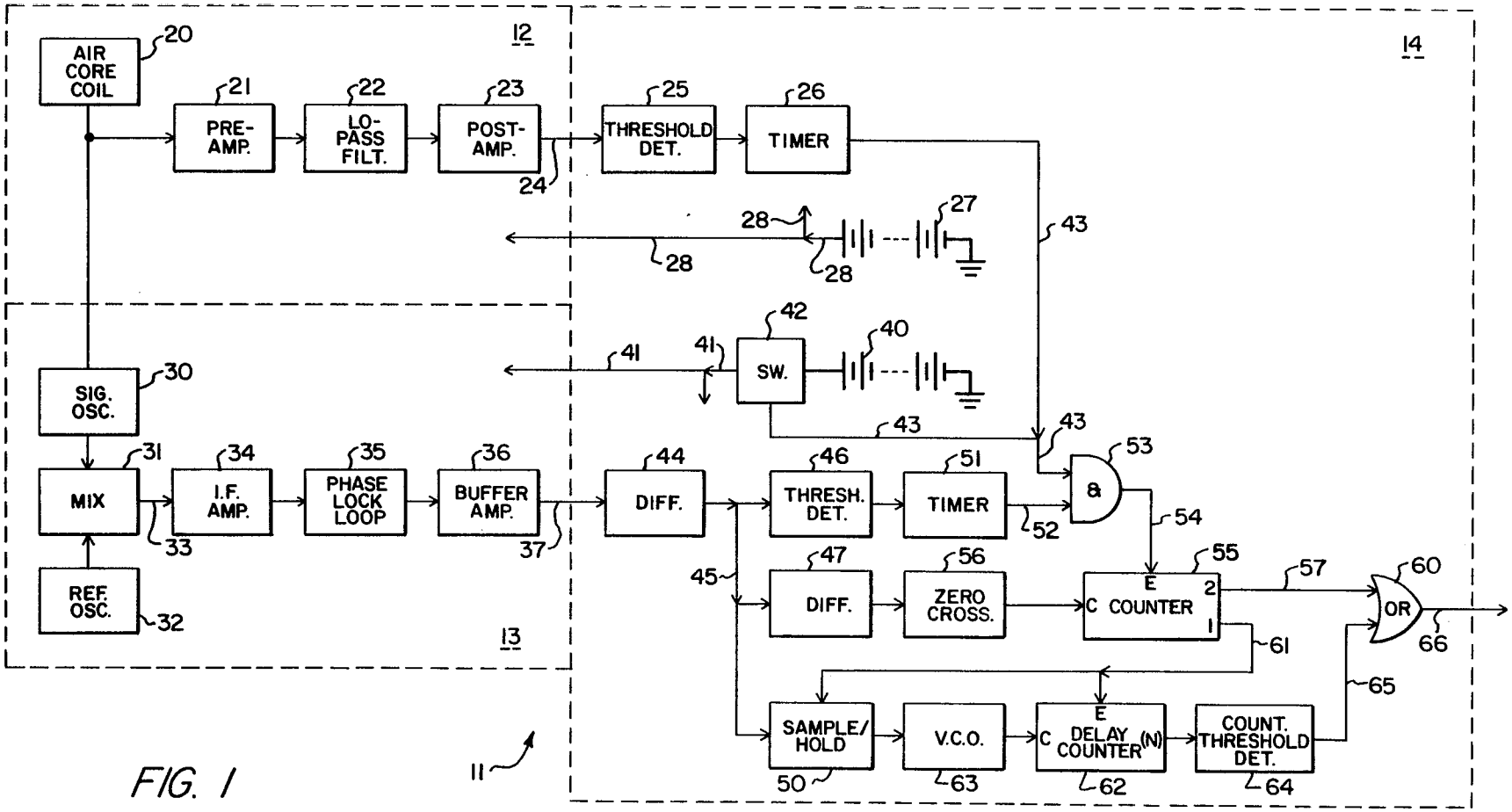
FIG. 1 shows, in block diagram, a mine fusing circuit according to the invention, and FIGS. 2 to 8 inclusive show wave forms of significance in the operation of the munition.

Turning now to FIG. 1, our mine fusing circuit 11 is shown to comprise a passive detector 12, an active detector 13, and signal processing logic 14.

Passive detector 12 includes an air-core coil 20 connected to a preamplifier 21 and then through a low-pass filter 22 to a post-amplifier 23, which supplies a first input 24 to logic 14. Filter 22 may have an upper cutoff frequency of less than 100 cycles per second. In logic 14 input 24 is supplied to a bipolar threshold detector 25 which controls a timer 26.

Members 21–26 are energized from a battery 27 as suggested by lead 28: they constitute a very small load on the battery, which accordingly has a long lite.

Coil 20 also forms a part of active detector 13, being connected as the inductor of a signal oscillator 30 operating in the frequency range of forty to sixty kilocycles: this frequency is, of course, not passed by filter 22 in passive detector 12. The signal from oscillator 30 is combined in a mixer 31 with the signal from a reference oscillator 32, to give an intermediate frequency output 33 which varies with the passing of a vehicle through the field. The intermediate frequency signal is fed through an intermediate frequency amplifier 34 to a phase-lock loop 35, the output of which is fed through a buffer amplifier 36 to comprise a second input 37 to logic 14.

Members 30–36, and the components of logic 14 about to be described, are energized from a second battery 40, as suggested by lead 41, when a switch 42 is closed. Closure of switch 42 is controlled by the output signal 43 of timer 26, so that unless passive detector 12 has supplied a proper output, active detector 13 is not energized and its relatively large load is not placed on battery 40. It will be realized that a single battery may be used instead of separate batteries, if this seems desirable.

Input 37 is supplied to a first differentiator 44, whose output 45 is supplied to a second threshold detector 46, to a second differentiator 47, and to a sample-and-hold circuit 50.

Detector 46 operates a second timer 51 giving an output 52. Outputs 52 and 43 are fed to a logical AND circuit 53 whose output 54 enables a counter 55.

Differentiator 47 supplies an output to a zero-crossing circuit 56 which in turn actuates counter 55 when the counter is enabled at 54. An output 57 from counter 55 is supplied as an input signal to a logical OR circuit 60. Another output 61 from counter 55 enables a second counter 62, and activates sample-and-hold circuit 50, the output of which is fed to a voltage controlled oscillator 63 to determine its frequency. The oscillator output drives counter 62 when the counter is enabled, and the counter output is fed to a further count threshold detector 64 which supplies a second signal 65 to OR circuit 60, which in turn supplies as its output 66 a "fire" signal for causing discharge of the mine.

OPERATION OF THE INVENTION

The operation of our invention will be best understood by referring to FIGS. 2–8 of the drawing.

Figure 2:
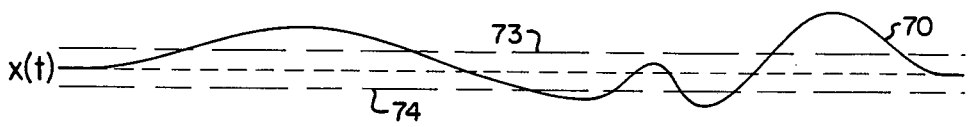
Figure 3:
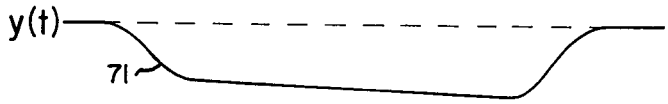
Figure 4:
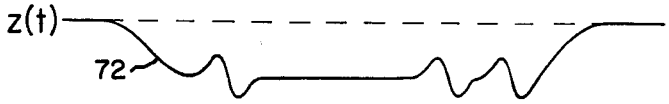

FIG. 2 shows a typical "signature" or signal 70 at input 24 resulting from the overpass of a vehicle over a passive detector. The masses of magnetic material at various locations in the vehicle react with the earth's magnetic field to cause variations in the number of lines of magnetic flux cutting the coil as the vehicle passes, which results in an output of an irregular wave form as shown. This signature begins while the vehicle is still some little distance away, and continues until the vehicle has passed on by some little distance. There is no way to determine from this signature what sort of a vehicle is overpassing. This is not the case, however, for an active detector, where the typical signature 71 of a tank, as shown in FIG. 3 is recognizably different from the signature 72 of a wheeled vehicle, as shown in FIG. 4. Note that the first, second, and third axles of a wheeled vehicle are clearly evident in the active detector signature, while the flat bottom hull of a tank is equally clearly displayed.

It is also to be noted that the signature from an active detector does not begin until the vehicle is nearly directly over the detector: this is not the case with a passive detector. When both detectors are present, the signal of a passive detector will reach a satisfactory threshold level before the signature of an active detector begins to appear.

FIGS. 5–8 show the results of once and twice differentiating the signatures of FIGS. 3 and 4, and will be referred to below in more detail.

When it is desired to interdict the passage of vehicles through a particular area, the area is sown with land mines according to the invention. The mines may be buried, but they are not large and not readily observable to a vehicle operator, and can frequently be distributed on the surface of the area, where they remain operable until their batteries 27 run down or predetermined time out occurs. The mines are shaped so that the axes of the coils are substantially vertical. In the initial condition of the munition, passive detector 12 is energized, but switch 42 is open, so that there is no load on battery 40, and no energization of detector 13 or of the logic elements connected thereto. Counters 55 and 62 are at zero and are disabled. This condition continues until a vehicle approaches the mine closely enough that the output of post-amplifier 23 passes the thresholds of detector 25, lines 73 and 74 of FIG. 2. When this happens, timer 26 operates, supplying a signal 43, which closes switch 42 for a predetermined interval, and also for that interval comprises a first input to AND circuit 53 even if the signature should drop within the thresholds.

Note that system operation thus far could also result from a vehicle passing beside the munition rather than overpassing it, and could also result from vehicles equipped with magnetic countermeasures: under these alternate conditions, discharge of a passively operated mine would be a waste of the munition. Our arrangement is such therefore that signal 43 alone is not sufficient to discharge the mine. If no second signal is supplied, from active detector 13, within the time interval set by timer 26, signal 43 ceases, and the mine reverts to its initial condition unless a signal at 24 of magnitude greater than that of threshold detector 25 continues to be present.

Closure of switch 42 by detector 12 energizes detector 13 and its related logic elements: because of the relation between the passive and active signatures, this takes place before the active signature of an approaching vehicle begins to appear.

It is intended that when a passive detector signal is present, the mine discharges almost at once when an active detector signal due to a wheeled vehicle appears, but discharges only after a delay when an active detector signal due to a tank appears. The delay is to be generally proportional to the speed of the tank, which the apparatus also determines. System operation for a tank will be considered first.

Figure 5:
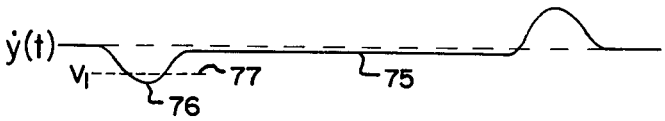

The signal 71 of FIG. 3 is fed through differentiator 44 and appears at 45 with the general wave form 75 of FIG. 5 having single initial pulse 76. This signal is supplied to detector 46 and is of sufficient magnitude to exceed the threshold 77 of the detector and cause the detector to energize timer 51, which supplies for a second interval a second signal 52 to AND circuit 53. The AND circuit acts at 54 to enable counter 55. The output 45 of differentiator 44 is also supplied to second differentiator 47, which supplies to zero-crossing detector 56 a wave form 80 shown in FIG. 6 to have a single initial zero-crossing 81. Detector 56 supplies a single pulse to counter 55, which has been enabled, and which gives a "1" output 61 which functions to enable counter 62 and activate sample-and-hold circuit 50.

Figure 6:
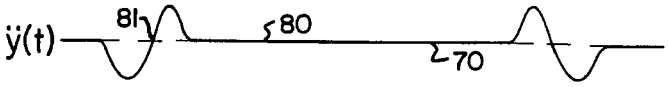
Figure 7:
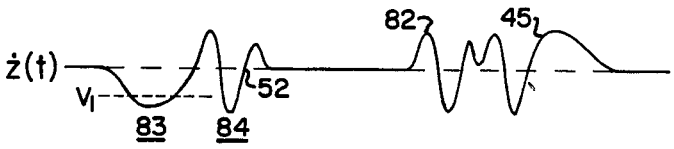
Figure 8:
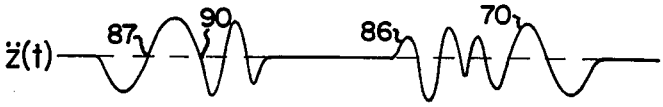

It is evident that the magnitude of pulse 76 in FIG. 5 at the zero crossing point 81 in FIG. 6 is determined by the speed of the moving vehicle. Circuit 50 supplies a signal determined by this magnitude to voltage controlled oscillator 63, to vary its frequency and hence to vary the rate at which pulses are supplied to counter 62, now enabled from counter 55. When the count from counter 62 reaches a predetermined number, as sensed by detector 64, it supplies a signal 65 to OR circuit 60. This signal has been delayed by the time required to reach the predetermined count at a rate determined by oscillator 63, and hence by the speed of the tank. After the delay, the firing signal is given at 66.

For a wheeled vehicle, operation is as follows. The signal 72 of FIG. 4 is fed through differentiator 44 and appears at 45 with the general wave form of 82 in FIG. 7 having a pair of initial pulses 83 and 84. This signal is supplied to detector 46 and the first pulse is of sufficient magnitude to exceed the threshold 77 of the detector and cause the detector to energize timer 51 as before, so that the timer supplies for the second interval a second signal to AND circuit 53, which acts at 54 to enable counter 55. The output 82 of differentiator 44 is also supplied to second differentiator 47, which supplies to zero-crossing detector a wave form 86 shown in FIG. 4 to have first and second zero-crossings 87 and 90. Detector 56 now supplies a pair of pulses to counter 55, which has been enabled, and gives a "two" output 57 which acts through OR circuit 60 to supply fire signal 66 at once. In this case, components 50, 63, 62, and 64 may operate but perform no function. In reaching its "two" output, counter 55 also gives a "one" output, but there is not time for this output to accomplish anything.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. In combination:

an air-core coil;

passive detecting means connected to said coil for giving a first output in response to change in the ambient magnetic field due to movement of a ferromagnetic body near said coil;

active detecting means connected to the same coil and energizable to create a local magnetic field about said coil and to give a second output in response to changes in said local field due to said movement of said body;

and means giving a further output in response to simultaneous outputs from said detecting means.

2. The combination of claim 1 in which said further output is immediate.

3. The combination of claim 1 in which said further output is delayed.

4. The combination of claim 3 in which the delay of said further output is determined by the rate of change of said output of said active detecting means.

5. In combination:

an air-core coil;

passive detecting means connected to said coil for giving a first output in response to change in the ambient magnetic field due to movement of a ferromagnetic body near said coil;

active detecting means connected to the same coil and operable to create a local magnetic field about said coil and to give a second output in response to changes in said local field due to said movement of said body;

means energizing said active detecting means in response to said output of said passive detecting means;

and means giving a further output in response to simultaneous outputs from said detecting means.

* * * * *